US006780008B2

(12) United States Patent
Koch et al.

(10) Patent No.: US 6,780,008 B2
(45) Date of Patent: Aug. 24, 2004

(54) GAS STOVE BURNER WITH SIMMER FLAME

(75) Inventors: Jürgen Koch, Attendorn (DE); Robert Zink, Hagen (DE)

(73) Assignee: Isphording Germany GmbH, Attendorn (DE)

( * ) Notice: Subject to any disclaimer, the term of this patent is extended or adjusted under 35 U.S.C. 154(b) by 0 days.

(21) Appl. No.: 10/439,980

(22) Filed: May 16, 2003

(65) Prior Publication Data

US 2003/0228550 A1 Dec. 11, 2003

(30) Foreign Application Priority Data

May 20, 2002 (DE) ..... 102 222 641

(51) Int. Cl.[7] ..... F23D 14/62; F23Q 9/00

(52) U.S. Cl. ..... 431/354; 431/284; 126/39 R; 239/558

(58) Field of Search ..... 431/354, 284; 126/39 R; 239/558

(56) References Cited

U.S. PATENT DOCUMENTS 2,619,164 A * 11/1952 Harper et al. ..... 431/284
5,277,576 A 1/1994 Hartung et al.
5,401,164 A * 3/1995 Yen ..... 431/354
6,132,205 A * 10/2000 Harneit ..... 431/354
6,244,263 B1 * 6/2001 Schlosser et al. ..... 126/39 R
6,322,354 B1 * 11/2001 Carbone et al. ..... 431/284
6,325,619 B2 * 12/2001 Dane ..... 431/284
6,332,460 B1 12/2001 Paesani

FOREIGN PATENT DOCUMENTS

| | | |
|---|---|---|
| CH | 87664 | 5/1919 |
| DE | 450536 | 10/1927 |
| DE | 41 25 308 | 2/1993 |
| EP | 534302 | 3/1993 |

* cited by examiner

*Primary Examiner*—Alfred Basichas
(74) *Attorney, Agent, or Firm*—Herbert Dubno; Andrew Wilford

(57) ABSTRACT

A gas stove burner has a base defining an axis and a ring assembly sitting on the base, forming therewith an annular outer compartment and a central inner compartment, and formed with an array of outwardly open lower passages open radially inward into the outer compartment. A generally imperforate cover disk overlying the ring assembly has an outer edge, upwardly closes the inner compartment, and forms with the ring assembly an array of upper passages open radially inward into the inner compartment and radially outward at the disk outer edge. Inlets on the base feed respective gas/air mixtures to the compartments and form a main flame at the edge from the mixture exiting the lower passages and a simmer flame at the edge from the mixture exiting the upper passages.

10 Claims, 1 Drawing Sheet

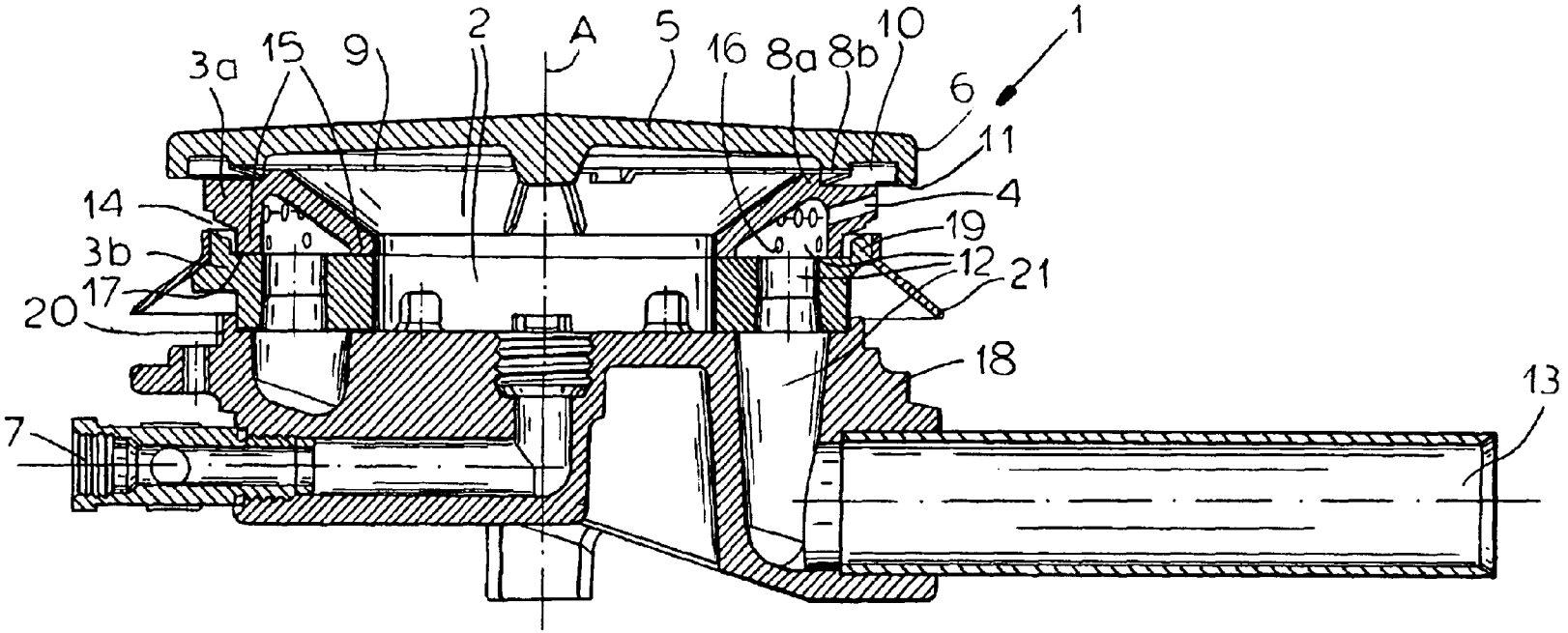
1
6
10
8b
8a
16
5
A
2
9
15
3a
14
3b
17
20
7
11
4
19
12
21
18
13

GAS STOVE BURNER WITH SIMMER FLAME

FIELD OF THE INVENTION

The present invention relates to a gas stove burner. More particularly this invention concerns such a burner which is set up to form a small separate simmer flame.

BACKGROUND OF THE INVENTION

A high-quality stove gas burner typically can produce a relatively large main flame and a smaller warming flame. The latter is normally set such that it cannot exceed a certain size, so that it can be used for simmering or warming but is not really powerful enough for most cooking procedures. The main flame is produced from nozzles that have an overall flow cross section that is much greater than the nozzles forming the warming flame. Typically the warming flame produces about 20% to 25% as much heat as the main flame.

In the system described in U.S. Pat. No. 5,277,576, the warming flame is centered in the burner and in this case it can be even smaller, between 10% and 12% of the overall burner capacity. While this is very handy for most applications, the centered position of this flame creates a hot spot in the center of the cooking utensil sitting on the burner, and in fact food can be burnt because of this concentrated location even in spite of the small size of the flame. Another disadvantage with this system is that a separate igniter must often be provided for the central flame, adding to the cost of the burner, and in general such a dual-flame burner can be quite complex.

OBJECTS OF THE INVENTION

It is therefore an object of the present invention to provide an improved gas burner for a cook stove.

Another object is the provision of such an improved gas burner for a cook stove which overcomes the above-given disadvantages, that is which has a full-size simmer flame.

SUMMARY OF THE INVENTION

A gas stove burner has according to the invention a base defining an axis and a ring assembly sitting on the base, forming therewith an annular outer compartment and a central inner compartment, and formed with an array of outwardly open lower passages open radially inward into the outer compartment. A generally imperforate cover disk overlying the ring assembly has an outer edge, upwardly closes the inner compartment, and forms with the ring assembly an array of upper passages open radially inward into the inner compartment and radially outward at the disk outer edge. Inlets on the base feed respective gas/air mixtures to the compartments and form a main flame at the edge from the mixture exiting the lower passages and a simmer flame at the edge from the mixture exiting the upper passages.

Thus with this system two different gas/air mixtures, one mixed for a large heating flame and the other for a small simmer flame, are fed to the burner and both create annular flames of generally the same diameter. The simmer flame is not a small point flame centered inside the main flame but instead is a large annular flame of the same size as the main flame. The provision of the jets for the simmer flame above those for the main flame eliminates the need for a second ignitor for the simmer flame, as when one moves to the simmer mode the main flame, which normally burns briefly as the simmer flame is started up, will serve to ignite it. What is more, when shifting back to use of the main flame, the residual gas of the simmer flame, even if same is extinguished, will be sucked up and consumed by the main flame.

According to the invention the ring assembly is formed by an upper ring and a lower ring centered on the axis and nested coaxially together. The cover disk can have a downwardly projecting annular ridge centered on the axis so that any spillage will not get into the burner. Furthermore this lip forms a downwardly open compartment that will be filled with the simmer-flame gas and make it less sensitive to drafts that might extinguish it.

In accordance with the invention the upper ring has an upwardly projecting annular ridge nested with the cover-disk ridge and the ridges together form an annular groove into which the lower passages open. One of the ridges is axially taller than the other of the ridges and supports the cover disk on the upper ring. This one tall ridge is formed with radially throughgoing notches forming the upper passages and is of triangular section so that it meets the other part in generally line contact, or as a series of circular line segments.

The cover disk according to the invention is of greater diameter than the ring assembly and the outer edge projects radially outwardly slightly past the ring assembly. Furthermore the outer compartment is annular and surrounds the inner compartment.

BRIEF DESCRIPTION OF THE DRAWING

The above and other objects, features, and advantages will become more readily apparent from the following description, reference being made to the accompanying drawing whose sole FIGURE is a partly diagrammatic vertical section through a burner according to the invention.

SPECIFIC DESCRIPTION

As seen in the drawing a gas cook-stove burner 1 according to the invention has a base 18 provided with simmer-flame and main-flame inputs 7 and 13 for respective different mixtures of gas and air. A pair of main-flame rings 3*a* and 3*b* sit atop the base 18, centered on a vertical center axis A thereof, and form a circularly annular main-flame compartment 12 communicating with the main-flame input 13. These rings 3*a* and 3*b* form together with a cover disk 5 a central simmer-flame compartment 2 communicating with the simmer-flame input 7.

The upper ring 3*a* is of downwardly open inverted-U section to form an upper part of the compartment 12 and the lower ring 3*b* is formed with a circular array of axially throughgoing passages forming a lower part of the compartment 12. The lower ring 3*b* is fitted snugly within an upwardly projecting circular rim 20 of the base 18 so that it is solidly anchored in place. The upper and lower rings 3*a* and 3*b* have respective downwardly and upwardly projecting annular ridges 15 and 19, the former fitting with play within the latter to form an annular space 14.

The upper ring 3*a* is formed above the ridge 15 with an array of radially outwardly and upwardly extending passages 4 from which a gas/air mixture fed in from the inlet 13 can exit to create a large-diameter main flame. In addition small radially throughgoing holes 16 are formed in the ridge 15 so that some gas mixture flows out into the space 14, ensuring that the main flame is annularly continuous.

The disk 5 is of a diameter greater than either of the rings 3*a* and 3*b*, measured where the holes 4 open, and is imperforate so that no gas mixture from the compartment 2 escapes the burner 1 through this disk 5. The upper ring 3*a* and cover disk 5 have respective upwardly and downwardly projecting ridges 8*a* and 8*b*, the former radially inside the latter and the latter having a sawtooth shape and being formed with radially throughgoing cutouts or notches 9.

Thus the gas mixture fed by the inlet 7 to the center simmer compartment 2 can escape through these notches 9 all around the ridges 8*a* and 8*b*. Such escaping gas enters a downwardly U-shaped channel 10 formed by the outer periphery 6 of the disk 5 and passes under an outer edge 11 of this disk 5. Thus it will form an annularly continuous small simmer flame of substantially the same diameter as the flame produced by gas exiting the compartment 12 through the holes 4 and 16. In addition, the downwardly projecting outer edge 11 prevents any spillage, for instance caused when a pot on the burner 1 boils over, from getting into the burner. A deflector skirt 21 attached to the lower ring 3*b* further diverts any such spillage radially outward, away from the burner 1.

We claim:

1. A gas stove burner comprising:

a base defining an axis;

a ring assembly sitting on the base, forming therewith an annular outer compartment and a central inner compartment, and formed with an array of outwardly open lower passages open radially inward into the outer compartment;

a generally imperforate cover disk overlying the ring assembly, having an outer edge, upwardly closing the inner compartment, and forming with the ring assembly an array of upper passages open radially inward into the inner compartment and radially outward at the disk outer edge; and inlet means on the base for feeding respective gas/air mixtures to the compartments and forming a main flame at the edge from the mixture exiting the lower passages and a simmer flame at the edge from the mixture exiting the upper passages.

2. The gas stove burner defined in claim 1 wherein the ring assembly is formed by an upper ring and a lower ring centered on the axis and nested coaxially together.

3. The gas stove burner defined in claim 2 wherein the cover disk has a downwardly projecting annular ridge centered on the axis.

4. The gas stove burner defined in claim 3 wherein the upper ring has an upwardly projecting annular ridge nested with the cover-disk ridge.

5. The gas stove burner defined in claim 4 wherein the ridges form an annular groove into which the lower passages open.

6. The gas stove burner defined in claim 4 wherein one of the ridges is axially taller than the other of the ridges and supports the cover disk on the upper ring.

7. The gas stove burner defined in claim 6 wherein the one ridge is formed with radially throughgoing notches forming the upper passages.

8. The gas stove burner defined in claim 6 wherein the one ridge is of triangular section.

9. The gas stove burner defined in claim 1 wherein the cover disk is of greater diameter than the ring assembly and the outer edge projects radially outwardly slightly past the ring assembly.

10. The gas stove burner defined in claim 1 wherein the outer compartment is annular and surrounds the inner compartment.

* * * * *

UNITED STATES PATENT AND TRADEMARK OFFICE

CERTIFICATE OF CORRECTION

PATENT NO. : 6,780,008 B2
DATED : August 24, 2004
INVENTOR(S) : Jürgen Koch et al.

It is certified that error appears in the above-identified patent and that said Letters Patent is hereby corrected as shown below:

Title page,
Item [30], Foreign Application Priority Data, for "102 222 641" read -- 102 22 641 --.

Signed and Sealed this

Fourteenth Day of December, 2004

JON W. DUDAS
*Director of the United States Patent and Trademark Office*